US006614182B2

(12) United States Patent
Yoshioka et al.

(10) Patent No.: US 6,614,182 B2
(45) Date of Patent: Sep. 2, 2003

(54) PLASMA DISPLAY PANEL

(75) Inventors: Toshihiro Yoshioka, Tokyo (JP); Akifumi Okigawa, Tokyo (JP)

(73) Assignee: NEC Corporation, Tokyo (JP)

( * ) Notice: Subject to any disclaimer, the term of this patent is extended or adjusted under 35 U.S.C. 154(b) by 49 days.

(21) Appl. No.: 10/028,347

(22) Filed: Dec. 20, 2001

(65) Prior Publication Data

US 2002/0084752 A1 Jul. 4, 2002

(30) Foreign Application Priority Data

Dec. 28, 2000 (JP) ..... 2000-400586

(51) Int. Cl.[7] ..... H01J 17/49
(52) U.S. Cl. ..... 313/584
(58) Field of Search ..... 313/491, 582, 313/584, 585

(56) References Cited

U.S. PATENT DOCUMENTS 6,384,531 B1 * 5/2002 Park et al. ..... 313/584
2002/0195939 A1 * 12/2002 Okigawa et al. ..... 313/584

* cited by examiner

*Primary Examiner*—Ross Gushi
(74) *Attorney, Agent, or Firm*—Scully, Scott, Murphy & Presser

(57) ABSTRACT

A plasma display panel (PDP), in which a high quality image is displayed by making its luminance and its luminance efficacy high and also its power consumption is reduced, is provided. The plasma display panel provides a group of plural pairs of sustaining electrodes covered with a dielectric layer on a first glass substrate by placing a discharge gap between the pair of sustaining electrodes, and a gas being filled up between the first glass substrate and a second glass substrate facing the first glass substrate. And an image is displayed on the PDP by irradiating ultraviolet light, which is obtained by making the group of plural pairs of the sustaining electrodes on the first glass substrate discharge by applying voltages to the group of plural pairs of the sustaining electrodes, on a fluorescent material. And a sustaining electrode in the pair of sustaining electrodes disposed on the nearly flat surface of the first glass substrate provides a discharge gap region electrode, a main surface discharge electrode, and an aperture disposed between the discharge gap region electrode and the main surface discharge electrode. And the main surface discharge electrode is composed of plural fine patterned wires and/or opening parts where electrodes are not formed.

15 Claims, 12 Drawing Sheets

(a)

(b)

(a)

(b)

PLASMA DISPLAY PANEL

BACKGROUND OF THE INVENTION

The present invention relates to a plasma display panel (PDP), being flat and capable of displaying a color image, whose screen size can be made to be large, and which is used such as for a personal computer (PC), a work station, and a wall TV set, and in which its luminance becomes higher and its power consumption is reduced.

DESCRIPTION OF THE RELATED ART

Conventionally, a surface discharge type PDP has been used. This conventional PDP provides a group of many pairs of sustaining electrodes covered with a dielectric layer on a first glass substrate. And a gas is filled in a space between the first glass substrate and a second glass substrate facing the first glass substrate, and a discharge is generated by applying voltages to these pairs of sustaining electrodes, and ultraviolet light is obtained. The obtained ultraviolet light is irradiated to a fluorescent material and visible rays are obtained. FIG. 1 is a plane view and a sectional view showing a structure of a first conventional PDP. FIG. 2 is a perspective view showing the structure of the first conventional PDP. And FIG. 3 is a plane view and a sectional view showing a structure of a second conventional PDP. As shown in FIGS. 1 to 3, a pair of sustaining electrodes 11 is formed on a first glass substrate 10 in a first substrate 1 for a unit discharge cell 300, and the pair of sustaining electrodes 11 is covered with a dielectric layer 12 made of low-melting glass. At this time, the thickness of the dielectric layer 12 on the pair of sustaining electrodes 11 becomes nearly uniform.

In a case that a structure, in which the thickness of the dielectric layer 12 on the pair of sustaining electrodes 11 is nearly uniform, is used, when the thickness of the dielectric layer 12 is made to be large, the luminance efficacy becomes high. However, the discharge sustaining voltage is increased. On the contrary, when the thickness of the dielectric layer 12 is made to be small, the discharge sustaining voltage can be made to be low, but the luminance efficacy becomes low.

In order to avoid the problem mentioned above, a structure is proposed. FIG. 4 is a sectional view showing a structure of a first substrate 1 of a third conventional PDP. As shown in FIG. 4, the thickness of the dielectric layer 12 is not uniform at a unit discharge cell. However, in this structure, the thickness of the dielectric layer 12 must be formed precisely in the whole unit discharge cells of the PDP, and the thickness of the dielectric layer 12 is liable to be uneven. Consequently, this affects the characteristics of the PDP, and this structure makes a high quality PDP difficult.

SUMMARY OF THE INVENTION

It is therefore an object of the present invention to provide a PDP, in which a high quality image is displayed by making its luminance and its luminance efficacy high and also its power consumption is reduced.

According to a first aspect of the present invention, for achieving the object mentioned above, there is provided a PDP. The PDP provides a group of plural pairs of sustaining electrodes covered with a dielectric layer on a first glass substrate, by placing a discharge gap between the pair of sustaining electrodes, and a gas being filled up between the first glass substrate and a second glass substrate facing the first glass substrate. And an image is displayed on the PDP by irradiating ultraviolet light, which is obtained by making the group of plural pairs of the sustaining electrodes on the first glass substrate discharge by applying voltages to the group of plural pairs of the sustaining electrodes, on a fluorescent material. And a sustaining electrode in the pair of sustaining electrodes disposed on the nearly flat surface of the first glass substrate provides a discharge gap region electrode, and a main surface discharge electrode, and an aperture disposed between the discharge gap region electrode and the main surface discharge electrode. And the main surface discharge electrode is composed of plural fine patterned wires and/or opening parts where electrodes are not formed.

According to a second aspect of the present invention, in the first aspect, the area of the main surface discharge electrode is 50% or less of the area of the region where the main surface discharge electrode is formed.

According to a third aspect of the present invention, in the first aspect, the area of the main surface discharge electrode is 30% or less of the area of the region where the main surface discharge electrode is formed.

According to a fourth aspect of the present invention, in the first aspect, the width of the fine patterned wire, of which the main surface discharge electrode is composed, is twice as narrow as or less of the value of the thickness of the dielectric layer for insulating the main surface discharge electrode from a discharge space.

According to a fifth aspect of the present invention, in the first aspect, the width of the discharge gap region electrode is 20% or less of the width of the sustaining electrode, disposed on the nearly flat surface of the first glass substrate, in the direction opposing the two sustaining electrodes each other in the pair of the sustaining electrodes.

According to a sixth aspect of the present invention, in the first aspect, the width of the discharge gap region electrode is 10% or less of the width of the sustaining electrode, disposed on the nearly flat surface of the first glass substrate, in the direction opposing the two sustaining electrodes each other in the pair of the sustaining electrodes.

According to a seventh aspect of the present invention, in the first aspect, the width of the aperture, which is disposed between the discharge gap region electrode and the main surface discharge electrode, is 10% or more of the width of the sustaining electrode in the direction opposing the two sustaining electrodes each other in the pair of the sustaining electrodes.

According to an eighth aspect of the present invention, in the first aspect, the width of the aperture, which is disposed between the discharge gap region electrode and the main surface discharge electrode, is 20% or more of the width of the sustaining electrode in the direction opposing the two sustaining electrodes each other in the pair of the sustaining electrodes.

According to a ninth aspect of the present invention, at least one of connecting electrodes for connecting the discharge gap region electrode and the main surface discharge electrode is disposed at the aperture that is disposed between the discharge gap region electrode and the main surface discharge electrode.

According to a tenth aspect of the present invention, in the ninth aspect, the area of the connecting electrodes is 20% or less of the area of the aperture.

According to an eleventh aspect of the present invention, in the first aspect, the thickness of the dielectric layer being nearly flat on the discharge gap region electrode is thinner than the thickness of the dielectric layer being nearly flat on the main surface discharge electrode.

According to a twelfth aspect of the present invention, in the first aspect, the sustaining electrode disposed on the nearly flat surface of the first glass substrate further provides a metal bus line positioned at the opposite side of the discharge gap region electrode and connected with both the discharge gap region electrode and the main surface discharge electrode, and a second aperture disposed between the main surface discharge electrode and the metal bus line. And the metal bus line makes wiring resistance of the sustaining electrode low.

According to a thirteenth aspect of the present invention, in the twelfth aspect, the width of the second aperture disposed between the main surface discharge electrode and the metal bus line is wider than the width of the aperture disposed between the discharge gap region electrode and the main surface discharge electrode.

According to a fourteenth aspect of the present invention, in the thirteenth aspect, a discharge is generated between the pair of the sustaining electrodes by applying voltages alternately to the pair of sustaining electrodes, and during a displaying discharge period by which the light emitting intensity of a light emitting display is controlled, the discharge is not spread in the region of the metal bus line beyond the second aperture.

According to a fifteenth aspect of the present invention, in the first aspect, the component of the gas generating ultraviolet light to irradiate to the fluorescent material is Xe, Kr, Ar, or nitrogen, and the partial pressure of the gas is 100 hPa or more.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 1:
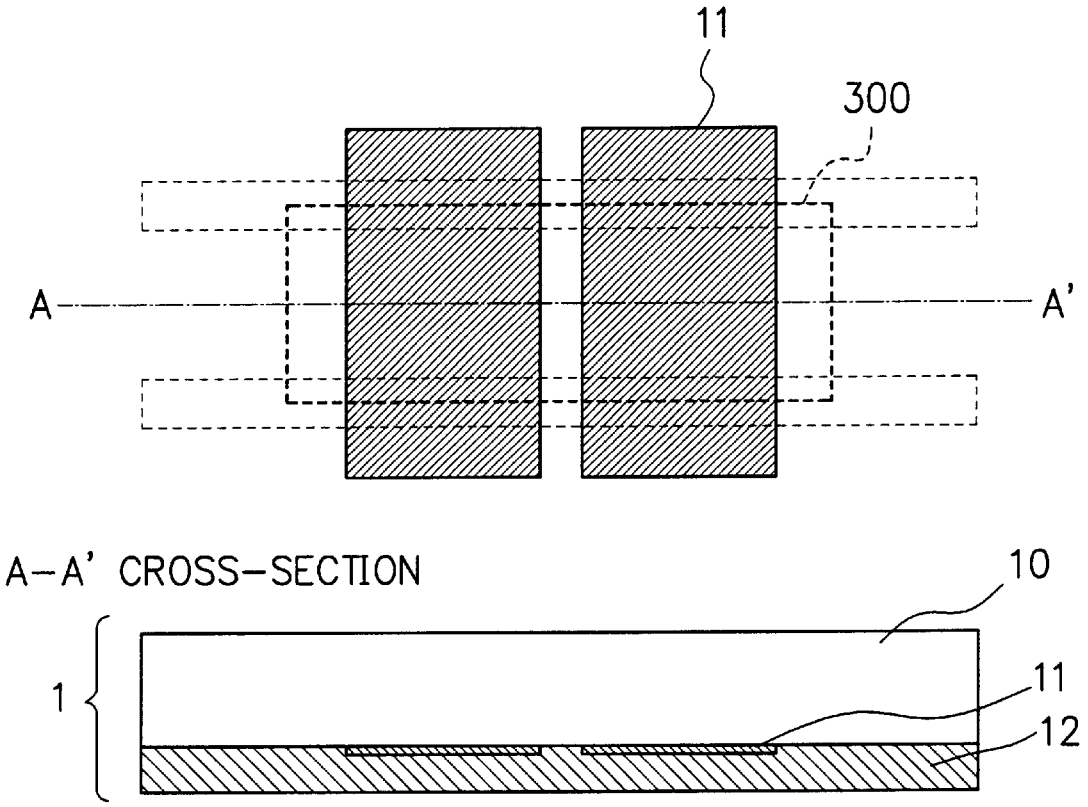
FIG. 1 PRIOR ART
FIG. 1 is a plane view and a sectional view showing a structure of a first conventional PDP.
Figure 2:
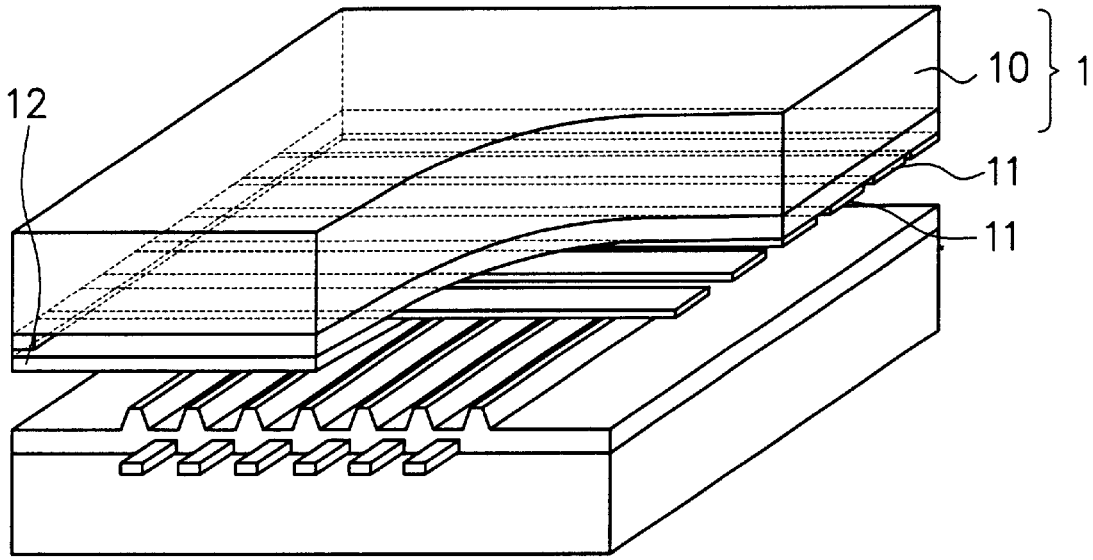
FIG. 2 PRIOR ART
FIG. 2 is a perspective view showing the structure of the first conventional PDP.
Figure 3:
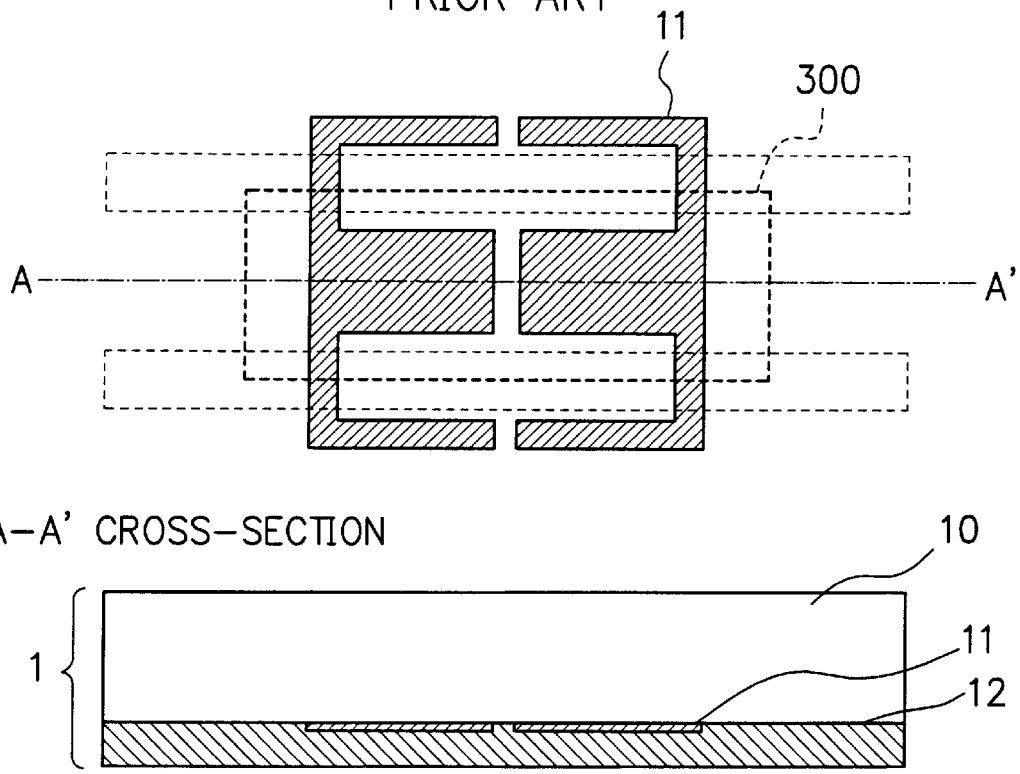
FIG. 3 PRIOR ART
FIG. 3 is a plane view and a sectional view showing a structure of a second conventional PDP.
Figure 4:
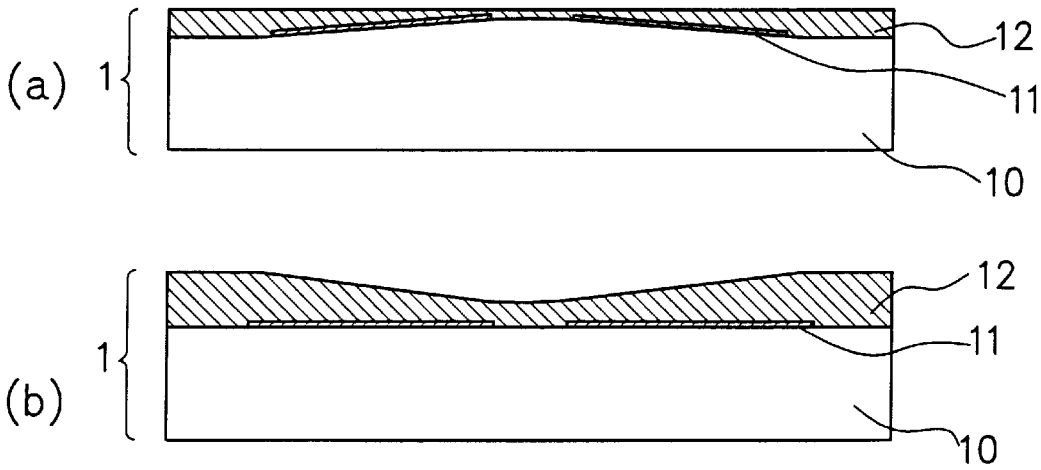
FIG. 4 PRIOR ART
FIG. 4 is a sectional view showing a structure of a first substrate of a third conventional PDP.

Referring now to the drawings, embodiments of the present invention are explained in detail. In the embodiments of the present invention, each element, which has a nearly equal function to that in the conventional PDPs, has the same reference number.

Figure 5:
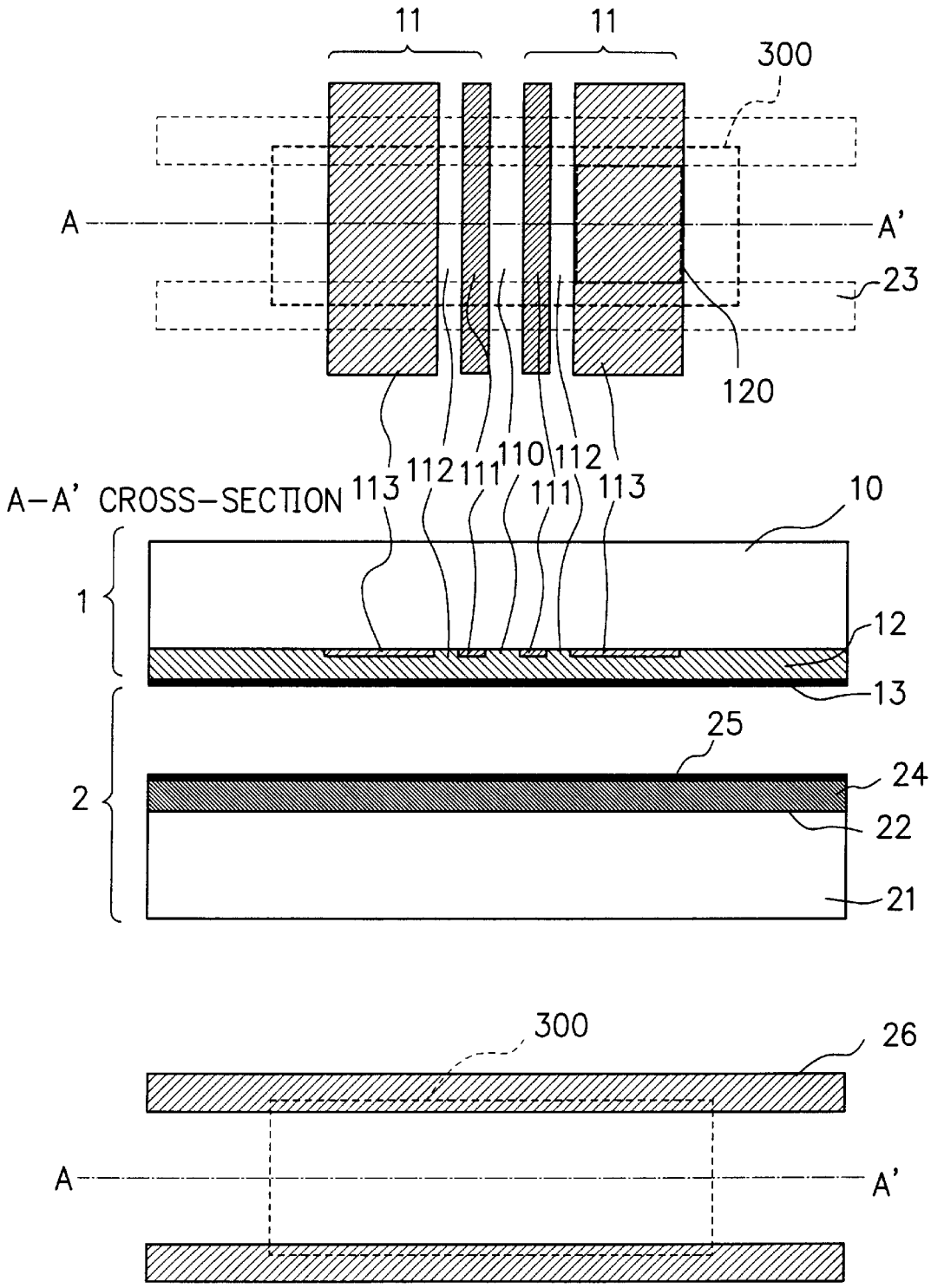
FIG. 5 is a plane view and a sectional view showing a structure of a first embodiment of a PDP of the present invention.

FIG. 5 is a plane view and a sectional view showing a structure of a first embodiment of a PDP of the present invention. As shown in FIG. 5, a pair of sustaining electrodes 11 is formed on a nearly flat surface of a first glass substrate 10, by placing a discharge gap 110 between the pair of the sustaining electrodes 11 at a unit discharge cell 300. The sustaining electrode 11 is composed of a discharge gap region electrode 111, which is positioned to the side of the discharge gap 110, and a main surface discharge electrode 113. An aperture 112 is disposed between the discharge gap region electrode 111 and the main surface discharge electrode 113. This structure of the sustaining electrode 11 is different from the conventional PDPs.

Figure 6:
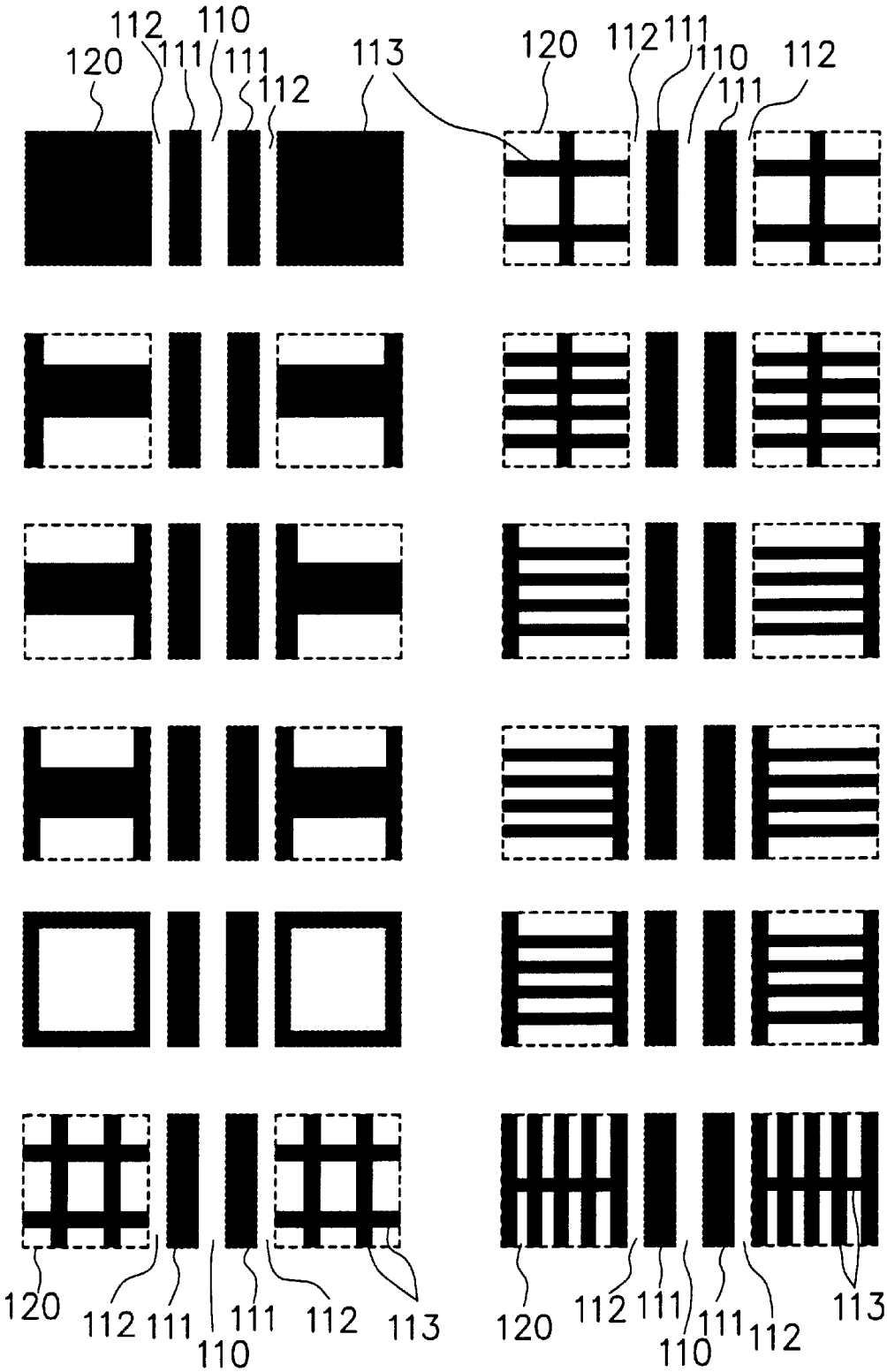
FIG. 6 is a diagram showing examples of structures of a main surface discharge electrode in a sustaining electrode shown in FIG. 5.

FIG. 6 is a diagram showing examples of structures of the main surface discharge electrode 113 in the sustaining electrode 11 shown in FIG. 5. As shown in FIG. 6, the main surface discharge electrode 113 has various shapes, and occupies a part or full of a main surface discharge electrode area 120. That is, the main surface discharge electrode 113 is formed at the main surface discharge electrode area 120. And the discharge gap region electrodes 111, the apertures 112, and the main surface discharge electrodes 113 are positioned symmetrically by placing the discharge gap 110 as their center axis in the pair of sustaining electrodes 11.

Figure 7:
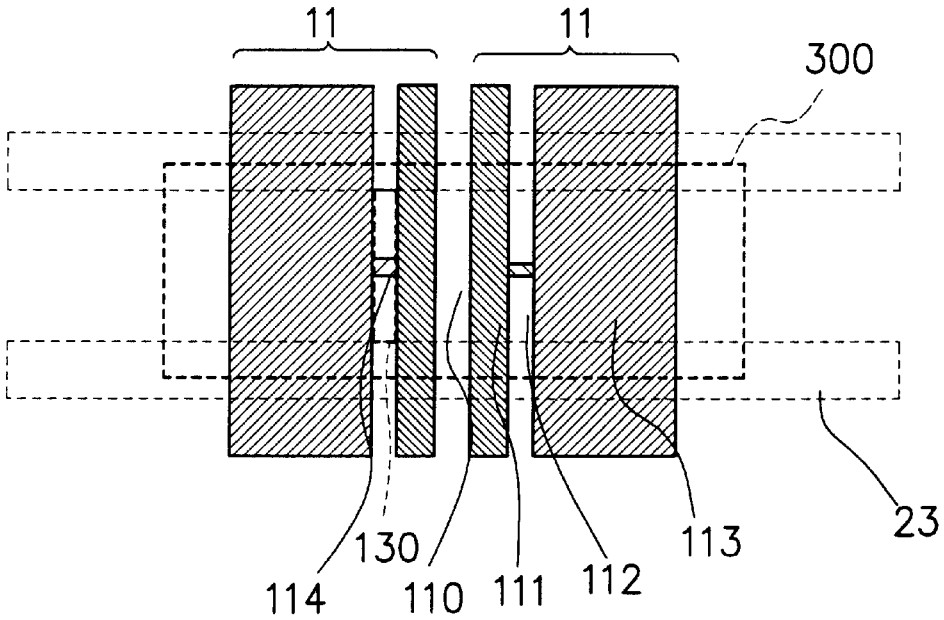
FIG. 7 is a plane view showing a structure of a pair of sustaining electrodes in a second embodiment of the PDP of the present invention.
Figure 7:
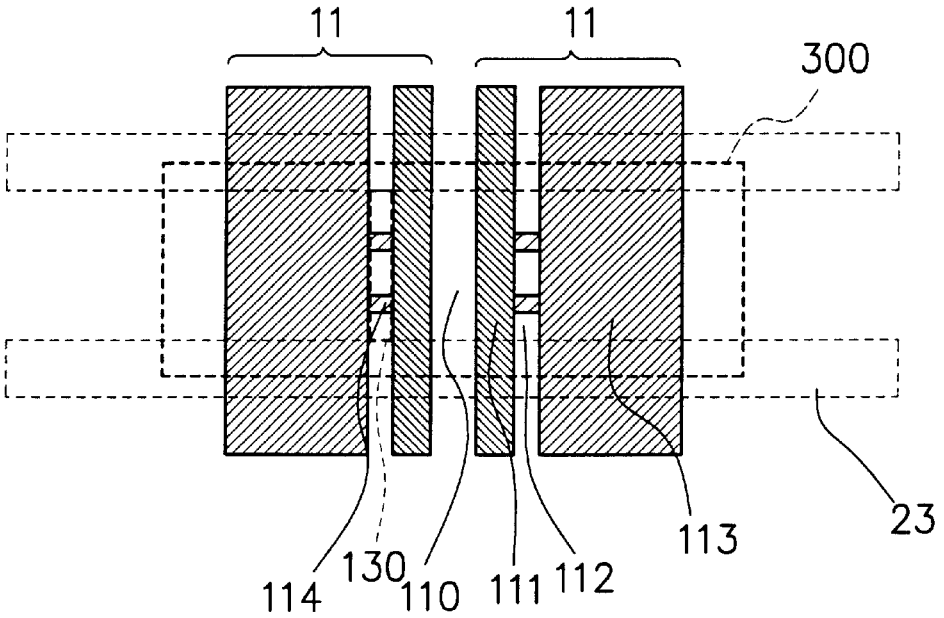
Figure 8:
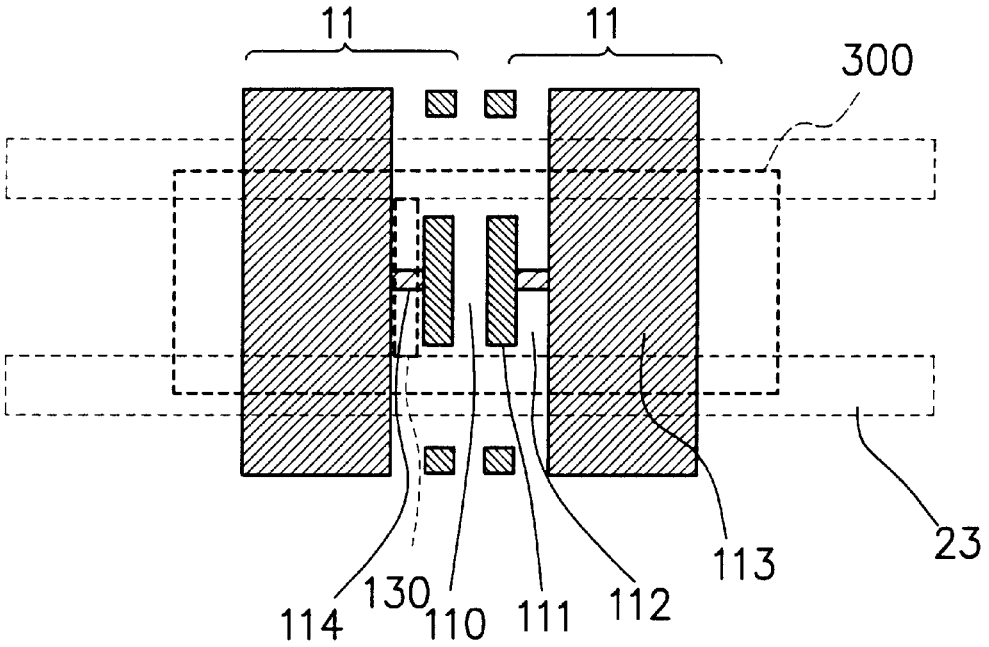
FIG. 8 is a plane view showing a structure of a pair of sustaining electrodes in a third embodiment of the PDP of the present invention.
Figure 8:
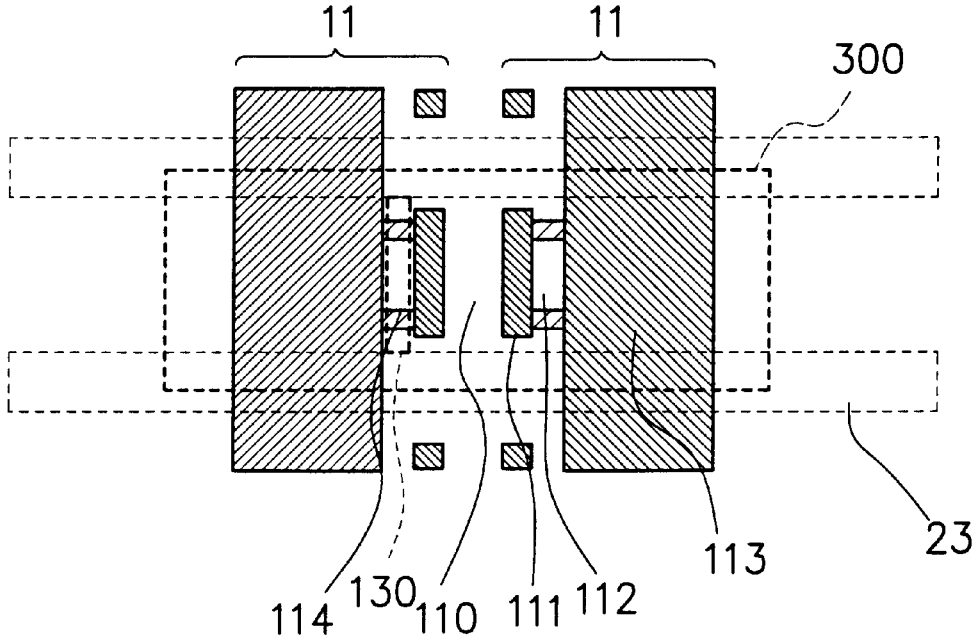

FIG. 7 is a plane view showing a structure of a pair of sustaining electrodes 11 in a second embodiment of the PDP of the present invention. FIG. 8 is a plane view showing a structure of a pair of sustaining electrodes 11 in a third embodiment of the PDP of the present invention. And FIG. 9 is a plane view and a sectional view showing a structure of the first substrate 1 in a fourth embodiment of the PDP of the present invention.

As shown in FIG. 7(*a*), the discharge gap region electrode 111 and the main surface discharge electrode 113 are connected with a connecting electrode 114 occupying a part of the aperture 112. And in FIG. 7(*b*), the discharge gap region electrode 111 and the main surface discharge electrode 113 are connected with two connecting electrodes 114 occupying a part of the aperture 112. Further, as shown in FIG. 8, the discharge gap region electrode 111 is divided and the divided discharge gap region electrode 111 is disposed in the unit discharge cell 300. The divided discharge gap region electrode 111 is connected to the main surface discharge electrode 113 with the connecting electrode 114 in FIG. 8(*a*), and with the connecting electrodes 114 in FIG. 8(*b*). The thickness of a dielectric layer 12 (not shown), which is formed on the pair of the sustaining electrodes 11, is nearly uniform.

Figure 9:
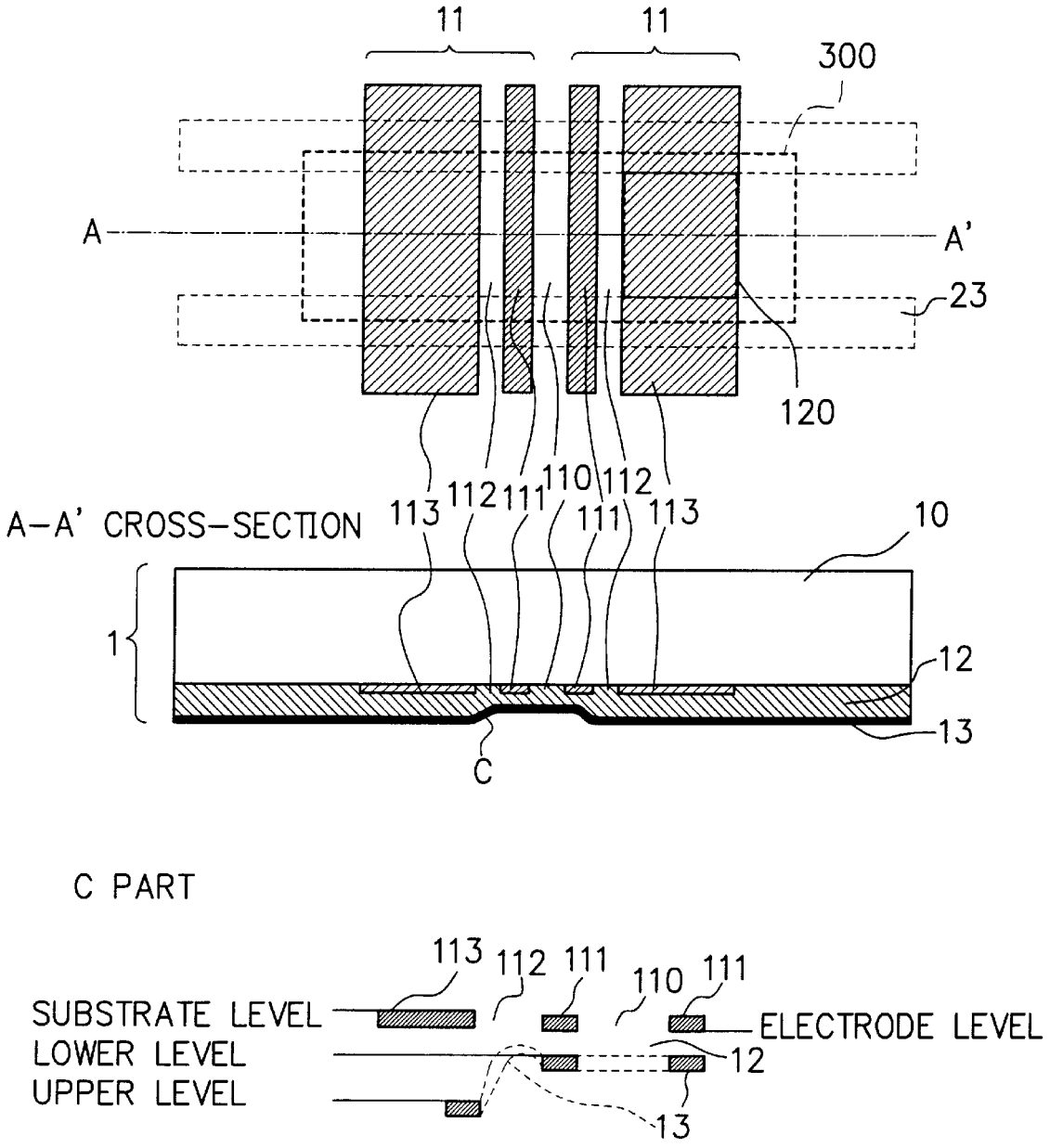
FIG. 9 is a plane view and a sectional view showing a structure of a first substrate in a fourth embodiment of the PDP of the present invention.

In the fourth embodiment of the present invention shown in FIG. 9, however, the thickness of the dielectric layer 12 on the discharge gap region electrode 111 is different from that on the main surface discharge electrode 113. This level difference is formed nearly on the aperture 112, which separates these two electrodes 111 and 113. As shown in FIG. 9, this level difference rises at the edge part of the main surface discharge electrode 113, and increases continuously on the aperture 112. On the discharging electrodes 111, there is no level difference. And this level difference falls continuously on the next aperture 112, and the surface of the dielectric layer 12 becomes again the original surface level on the next main surface discharge electrode 113. The shape of this level difference is not limited to a specific shape, and is possible to be steps, concave, or convex. In the fourth embodiment, the connecting electrode(s) 114, which is used in the second and third embodiments, can be used between the discharge gap region electrode 111 and the main surface discharge electrode 113.

In the second and third embodiments shown in FIGS. 7 and 8, the discharge gap region electrode 111 and the main surface discharge electrode 113 are connected so that their electric potential becomes almost equal. This is the same in the fourth embodiment in case that the fourth embodiment has the connecting electrode(s) 114.

Figure 10:
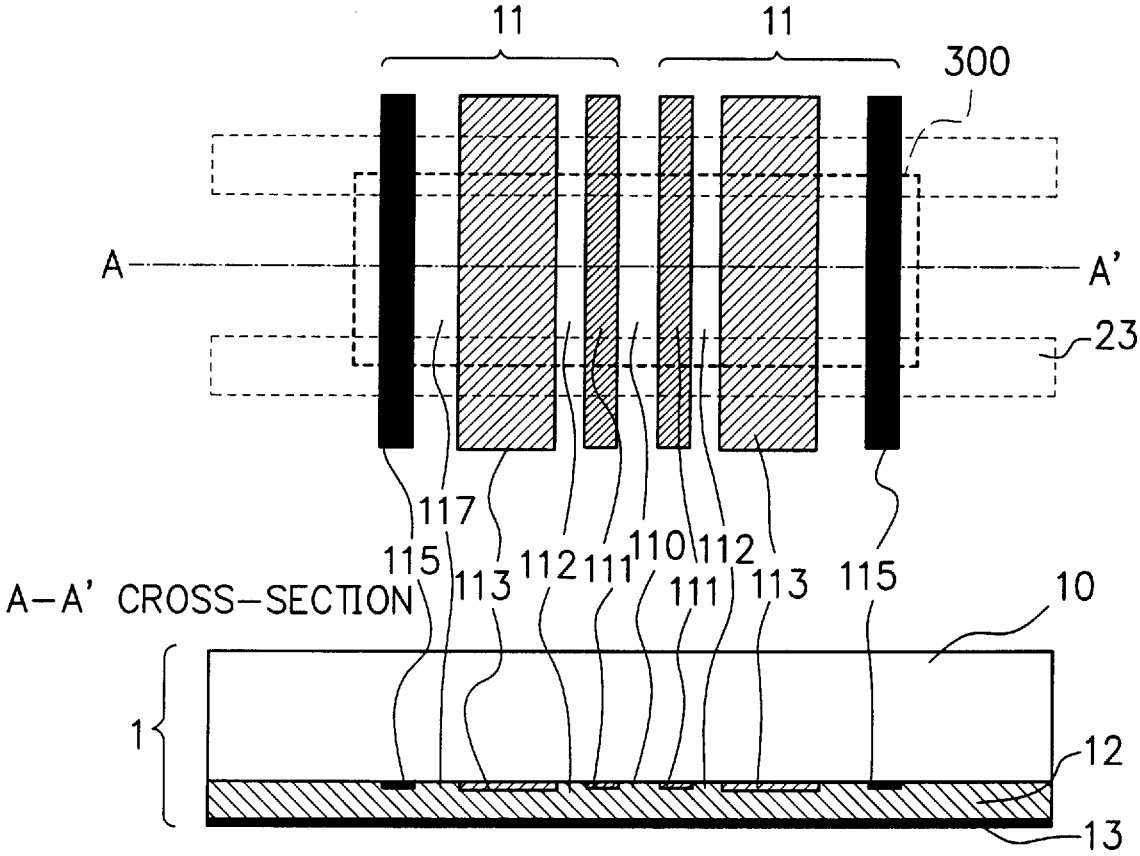
FIG. 10 is a plane view and a sectional view showing a structure of a pair of sustaining electrodes in a fifth embodiment of the PDP of the present invention.

FIG. 10 is a plane view and a sectional view showing a structure of a pair of sustaining electrodes 11 in a fifth embodiment of the PDP of the present invention. As shown in FIG. 10, in the fifth embodiment, the sustaining electrode 11 provides a metal bus line 115, in addition to the discharge gap region electrode 111 and the main surface discharge electrode 113. This metal bus line 115, positioned almost in parallel with the electrodes 111 and 113, is disposed by placing a second aperture 117 between the main surface discharge electrode 113 and the metal bus line 115.

Figure 11:
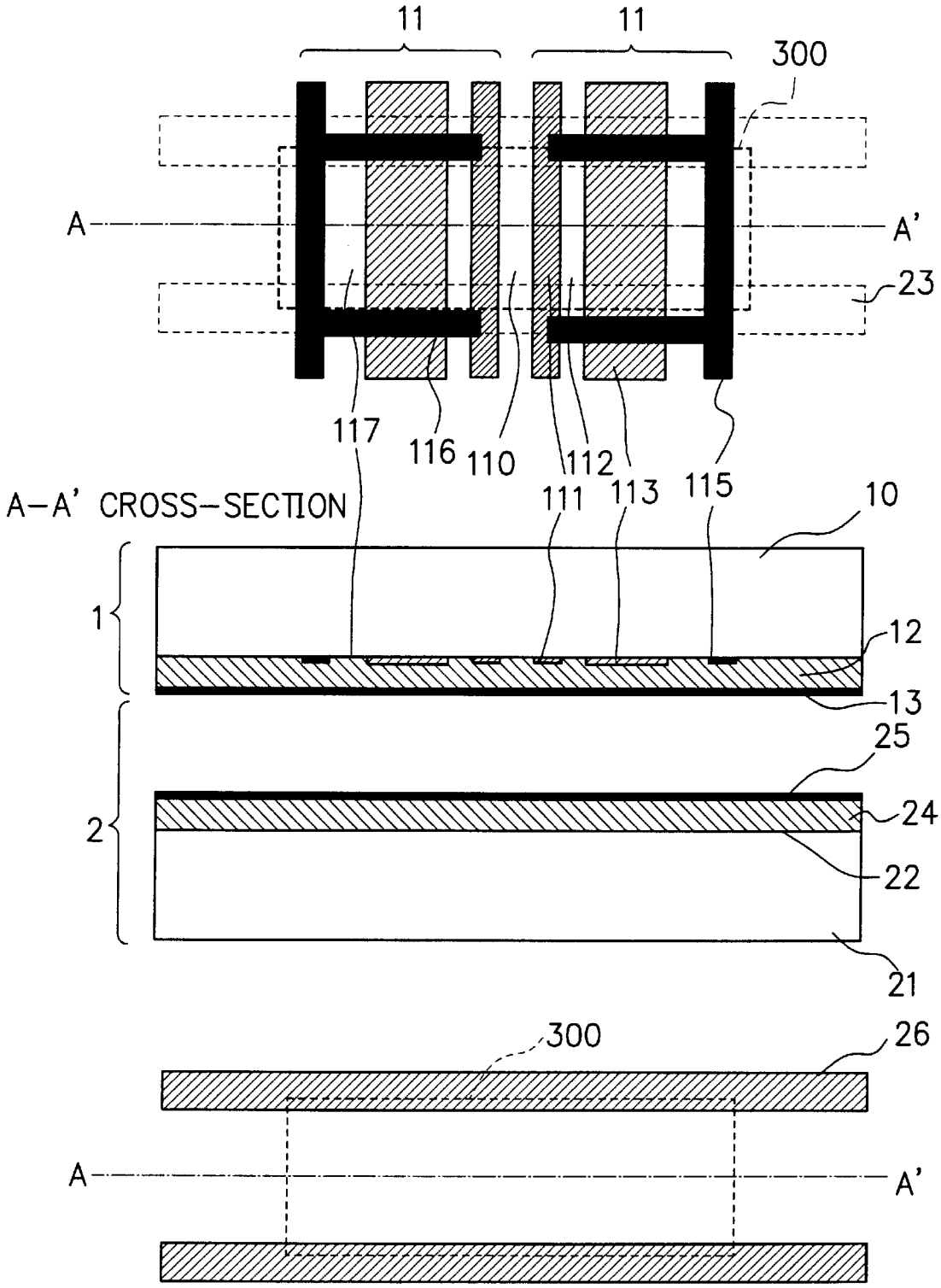
FIG. 11 is a plane view and a sectional view showing a structure of a pair of sustaining electrodes in a sixth embodiment of the PDP of the present invention.

FIG. 11 is a plane view and a sectional view showing a structure of a pair of sustaining electrodes 11 in a sixth embodiment of the PDP of the present invention. As shown in FIG. 11, the metal bus line 115, the discharge gap region electrode 111, and the main surface discharge electrode 113 are connected with connecting metals 116. These connecting metals 116 are formed on upper surfaces of barrier ribs 23, which are the upper surfaces of the barrier ribs 26 formed on a second substrate 2 and contacts with the first substrate 1. With this, the pair of the sustaining electrodes 11 is sustained in a low resistance value, and the discharge gap region electrode 111, the main surface discharge electrode 113, and the metal bus line 115 are sustained in the same electric potential. In the fifth and sixth embodiments shown in FIGS. 10 and 11, the discharge gap region electrode 111, the main surface discharge electrode 113, and the metal bus line 115 are positioned symmetrically as that the discharge gap 110 is their center axis. And the aperture 112 is disposed between the discharge gap region electrode 111 and the main surface discharge electrode 113, and the second aperture 117 is disposed between the main surface discharge electrode 113 and the metal bus line 115.

In the embodiments of the PDP of the present invention, a gas, which mainly generates ultraviolet light, is filled up and sealed in a discharge space between the first substrate 1 and the second substrate 2. This gas is xenon (Xe), krypton (Kr), argon (Ar), or nitrogen, and its partial pressure is 100 hPa or more. Helium (He) or neon (Ne) can be included in this gas.

In the embodiments of the present invention, the total gas pressure is several 10 hPa to 1 atm. (1013.25 hPa), and 100 hPa to 1 atm. is acceptable. Furthermore, preferably, the range of the total gas pressure is 300 hPa to less than 1 atm. At a high place whose pressure is 1 atm. or less, the gas pressure can be set to be up to the pressure at the place, for example, about 800 hPa. It is desirable that the total pressure is about 300 to 800 hPa. And also it is desirable that the partial pressure of the gas being ultraviolet light source is several 10 to 500 hPa.

Next, referring to the drawings, a manufacturing method of the PDP of the present invention is explained. In the first embodiment shown in FIG. 5, first, the pair of the sustaining electrodes 11 made of a transparent conductive material thin film, whose main component is tin oxide or indium oxide, is formed on the first glass substrate 10 by etching or a lift-off method. The sustaining electrode 11 provides at least two electrodes 111 and 113 and the aperture 112 between the electrodes 111 and 113, as shown in FIG. 5. In this, in case that the width of fine patterned wires, of which the main surface discharge electrode 113 is composed, is 30 $\mu$m or less, and the area of the main surface discharge electrode 113 is 30% or less of the main surface discharge electrode area 120 as shown in FIG. 6, a conductive material being different from the transparent conductive material thin film can be used for the main surface discharge electrode 113. This conductive material is a metal thin film or a conductive material containing metal fine particles whose reflection factor for its discharge space side is 50% or more.

In the embodiments of the present invention, as mentioned above, the etching or the lift-off method was used to form the pair of the sustaining electrodes 11. However, this forming method is not limited to the methods mentioned above, and other film forming methods and patterning methods can be used.

Next, the dielectric layer 12 being transparent made of such as low-melting glass is formed with almost flat surface by covering the pair of the sustaining electrodes 11. It is desirable that the width of the fine patterned wires, of which the main surface discharge electrode 113 is formed, is twice as narrow as or less of the value of the thickness of the dielectric layer 12.

Last, a magnesium oxide layer 13, which is a protection layer, is formed on the surface, which contacts with the discharge space, of the dielectric layer 12. With the processes mentioned above, the first substrate 1 is formed.

In the second substrate 2 facing the first substrate 1, a data electrode 22 and a white dielectric layer 24 covering the data electrode 22 are formed on the second glass substrate 21. Barrier ribs 26, which decide the discharge space, is formed on the white dielectric layer 24, and a fluorescent material layer 25 is formed on the white dielectric layer 24 decided by the barrier ribs 26.

Next, comparing with the conventional PDP shown in FIGS. 1 to 4, the present invention is explained. The PDP of the present invention realized the high luminance efficacy by reducing the discharge current density without lowering the luminance.

Further, at the present invention, a remarkable good effect was realized by changing the area ratio between the area of the main surface discharge electrode 113 and the main surface discharge electrode area 120. In this, the area ratio is that the area of 113 is divided by the area of 120. When the area ratio was 50% or less, or preferably 30%, the remarkable good effect was recognized. The reason, why the remarkable good effect was realized, is that the discharge current at the main surface discharge electrode 113 being a main discharge region was reduced.

Figure 12:
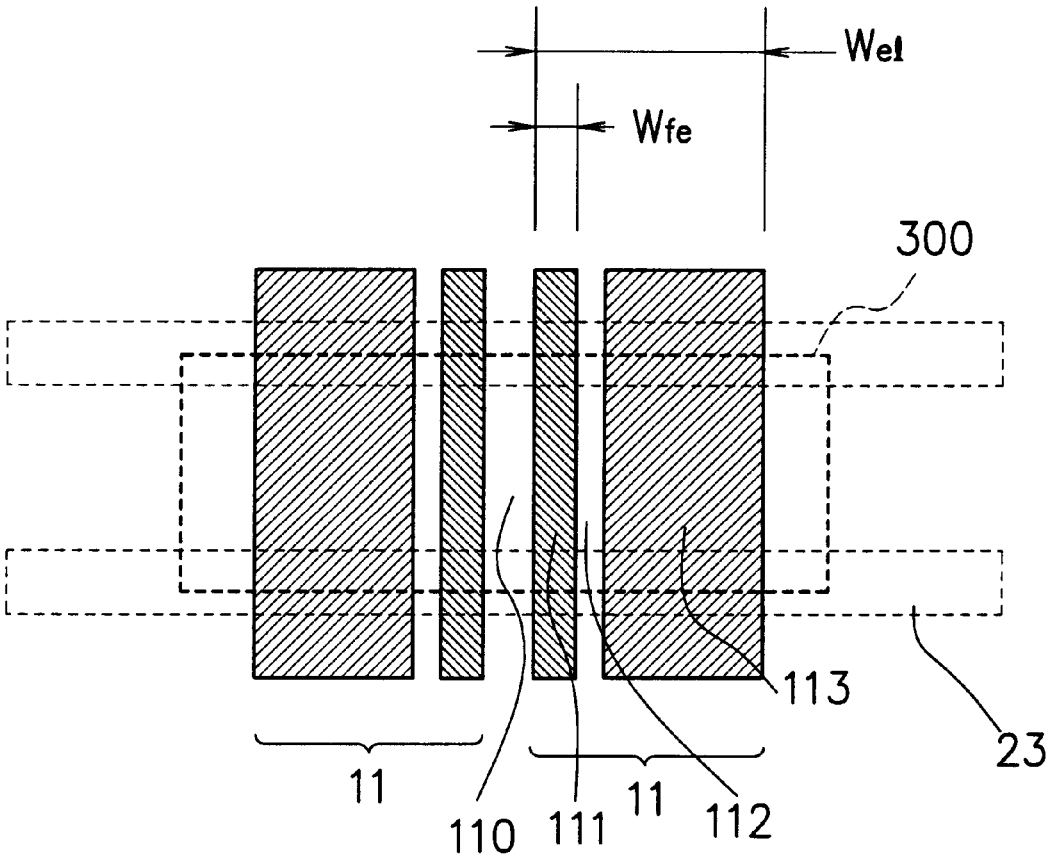
FIG. 12 is a plane view showing a distance relation in the pair of the sustaining electrodes of the PDP of the present invention.

FIG. 12 is a plane view showing a distance relation in the pair of the sustaining electrodes 11 of the PDP of the present invention. As shown in FIG. 12, the width of the sustaining electrode 11 is defined as Wel, and the width of the discharge gap region electrode 111 is defined as Wfe. When the width ratio (Wfe/Wel) becomes 20% or less, preferably 10% or less, the high luminance efficacy can be realized by reducing the discharge current density.

Figure 13:
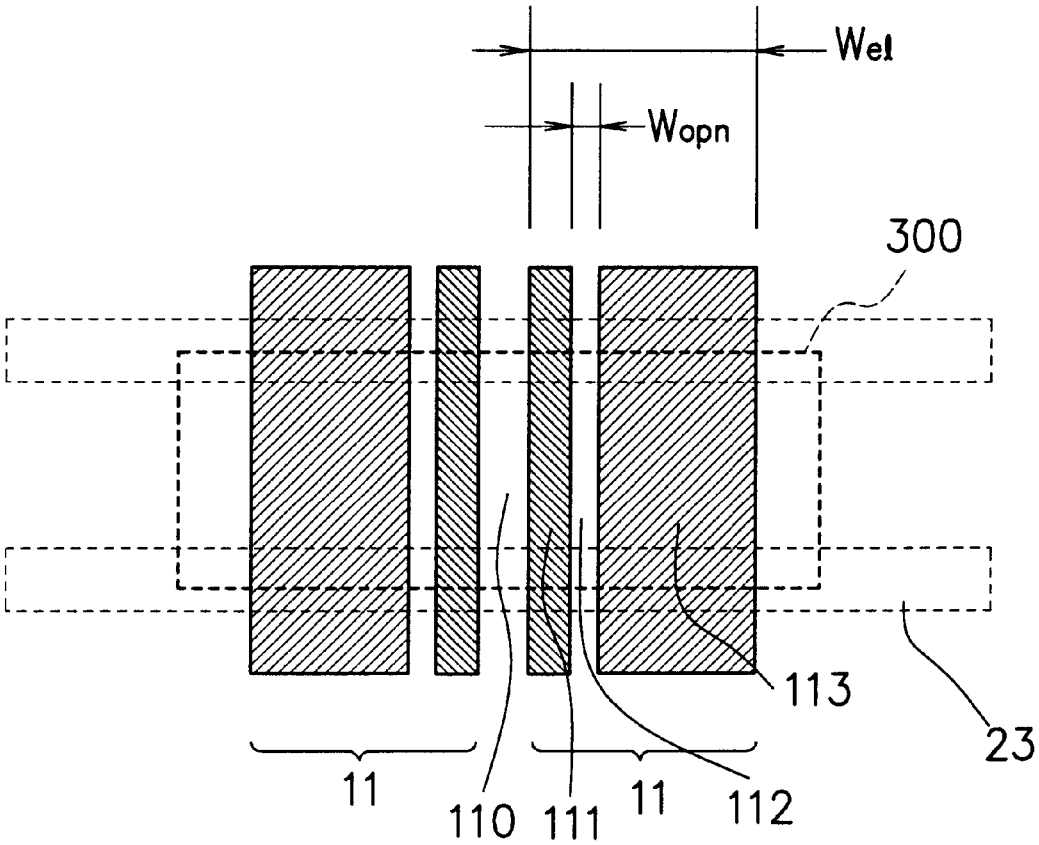
FIG. 13 is another plane view showing a distance relation in the pair of the sustaining electrodes of the PDP of the present invention.

FIG. 13 is another plane view showing a distance relation in the pair of the sustaining electrodes 11 of the PDP of the present invention. As shown in FIG. 13, in case that the width of the aperture 112 is defined as Wopn, when the width ratio (Wopn/Wel) is 10% or more, preferably, 20% or more, the high luminance efficacy can be realized by reducing the discharge current density. This is, when a large discharge generated at the discharge gap 110 transfers to the main discharge region, discharge factors relating to the discharge efficiency such as the electronic temperature are controlled to be higher efficiency.

Referring to FIGS. 7 and 8, the second and third embodiments of the present invention are explained in more detail. As mentioned above, the connecting electrode(s) 114 is provided at a part of the aperture 112, disposed between the discharge gap region electrode111 and the main surface discharge electrode 113. This connecting electrode 114 works to help to transfer the discharge generated at the discharge gap 110 to the main surface discharge electrode 113, in which the main discharge is formed, in a degree that does not decrease the effect of the aperture 112 mentioned above. With the structures mentioned above, the high luminance efficacy was realized by reducing the discharge current density without lowering the luminance.

In order to confirm the size of the connecting electrode 114 without decreasing the effect of the aperture 112, the ratio of the area of the connecting electrode 114 to an area 130 of the aperture 112 was evaluated. In case that this ratio (the area of 114/the area of 130) is 20% or less, the luminance efficacy of the PDP of the present invention was especially increased. The connecting electrodes 114 are not necessary to be a pair as shown in FIGS. 7(*a*) and 8(*a*), but plural pairs of the connecting electrodes 114 can be disposed as shown in FIGS. 7(*b*) and 8(*b*). That is, the size and the number of the connecting electrodes 114 are not limited to the embodiments mentioned above, they are acceptable as far as the ratio is 20% or less.

In the second embodiment shown in FIG. 7, a pair of the discharge gap region electrodes 111 are disposed symmetrically as the discharge gap 110 is their center axis.

In the third embodiment shown in FIG. 8, in addition to the structure mentioned in the second embodiment, the pair of the discharge gap region electrodes 111 are divided and the divided pair of discharge gap region electrodes is disposed in the unit discharge cell 300. In FIG. 8, the electric potential of the divided discharge gap region electrodes 111 is preferably equal to that of the main surface discharge electrode 113. However, the electric potential of the part of the discharge gap region electrode 111, which is positioned between the upper surfaces of barrier ribs 23, can be controlled to be a little higher or lower than that of the main surface discharge electrode 113. As mentioned above, the electric potential of the discharge gap region electrode 111 can be set arbitrary. In FIGS. 7 and 8, the number of the connecting electrodes 114 is one or two, however, the number is not limited to the number mentioned above.

Next, referring to FIG. 9, the fourth embodiment of the present invention is explained in more detail. In the fourth embodiment, the shape of the main surface discharge electrode 113 can be changed applying the first embodiment shown in FIG. 6. In the fourth embodiment, the thickness of the dielectric layer 12 on the pair of the sustaining electrodes 11 is changed. In order to form the dielectric layer 12 having level difference parts, the level difference parts are formed by using low-melting glass, and are burned at a temperature near the glass softening point, and this non-flat dielectric layer 12 is formed. With this structure, the current density of the main discharge was reduced largely, and the luminance efficacy was improved.

At the fourth embodiment, even if the discharge gap region electrode 111 and the main surface discharge electrode 113 are formed almost continuously, without disposing the aperture 112, the luminance efficacy can be improved a little. However, in a structure, in which the aperture 112 does not exist or the area of the aperture 12 is small (not enough), in case that the level difference parts of the pair of the sustaining electrodes 11 are not symmetry for the center axis of the discharge gap 110, the dispersion of the discharge characteristics becomes large. On the contrary, in a structure having the aperture 112, even when the level difference parts of the pair of the sustaining electrodes 11 are positioned not symmetrically a little for the center axis of the discharge gap 110, that is, even when the level difference parts are not positioned symmetrically, the dispersion of the characteristics is small, and the luminance efficacy can be improved.

At the C part in FIG. 9, the dielectric layer 12 is formed between the upper level and the electrode level under the main surface discharge electrode 113, and is formed between the lower level and the electrode level under the discharge gap 110 and the discharge gap region electrodes 111. The aperture 112 can be disposed between the lower and electrode levels of the dielectric layer 12. At the range of the discharge gap 110, the dielectric layer 12 is preferably provided up to the lower level, however, can be provided up to near the substrate level of the first glass substrate 10. As mentioned above, the dielectric layer 12 can be formed with the level difference on the first glass substrate 10, by not forming with the same thickness.

Next, referring to FIGS. 10 and 11, the fifth and sixth embodiments of the present invention are explained in more detail. As mentioned above, in FIG. 10, the metal bus line 115, made of a metal thin film, metal particles, or low-melting glass containing metal particles, which makes wiring resistance of the pair of the sustaining electrodes 11 low, is formed in parallel with the discharge gap region electrode 111 and the main surface discharge electrode 113. The second aperture 117 is disposed between the metal bus line 115 and the main surface discharge electrode 113. In FIG. 11, in order to make the electric potential of the discharge gap region electrode 111 and the main surface discharge electrode 113 equal, the connecting metals 116 are provided at the part corresponding to the upper surfaces of the barrier ribs 23. With this structure, the luminance efficacy can be improved. In this case, it is desirable that a discharge, transferred to the main surface discharge electrode 113 from the discharge gap region electrode 111, is not transferred to the metal bus line 115. In order to achieve this, the width of the second aperture 117, which is disposed between the main surface discharge electrode 113 and the metal bus line 115, is made to be wider than that of the aperture 112, which is disposed between the discharge gap region electrode 111 and the main surface discharge electrode 113.

As mentioned above, in the embodiments of the present invention, it is desirable that each electrode in the pair of the sustaining electrodes 11 is positioned symmetrically as the discharge gap 110 is their center axis. That is, it is ideal that the shape and area of the same electrodes and the interval among the electrodes are almost equal. However, the degree of the symmetry is not strict, and it is desirable that the order positioning the electrodes and apertures is symmetry for the discharge gap 110. However, it is enough that the shape and area of the same electrodes and the interval among the electrodes are almost equal. And the small difference in the intervals and the areas is acceptable. Cases, in which the symmetry is not satisfied completely, are included in the present invention, as far as the effects of the present invention are realized.

As mentioned above, according to the present invention, a PDP, in which a high quality image is displayed by making its luminance and its luminance efficacy high and its power consumption is reduced, can be realized.

As mentioned above, a PDP of the present invention provides a group of plural pairs of sustaining electrodes covered with a dielectric layer on a first glass substrate by placing a discharge gap between the pair of sustaining electrodes, and a gas is filled up between the first glass substrate and a second glass substrate facing the first glass substrate. And an image is displayed on the PDP by irradiating ultraviolet light, which is obtained by making the group of plural pairs of the sustaining electrodes on the first glass substrate discharge by applying voltages to the group of plural pairs of the sustaining electrodes, on a fluorescent material. And a sustaining electrode in the pair of sustaining electrodes disposed on the nearly flat surface of the first glass substrate provides a discharge gap region electrode, a main surface discharge electrode, and an aperture disposed between the discharge gap region electrode and the main surface discharge electrode. And the main surface discharge electrode is composed of plural fine patterned wires and/or opening parts where electrodes are not formed.

And when the area of the main surface discharge electrode is 50% or less, or 30% or less of the area of the region where the main surface discharge electrode is formed, the effect of the present invention can be realized. Further, when the width of the fine patterned wire, of which the main surface discharge electrode is composed, is twice as narrow as or less of the value of the thickness of the dielectric layer for insulating the main surface discharge electrode from a discharge space, the effect of the present invention can be realized. And when the width of the discharge gap region electrode is 20% or less, or 10% or less of the width of the sustaining electrode, disposed on the nearly flat surface of the first glass substrate, in the direction opposing the tow sustaining electrodes each other in the pair of the sustaining electrodes, the effect of the present invention can be realized. And when the width of the aperture, which is disposed between the discharge gap region electrode and the main surface discharge electrode, is 10% or more, or 20% or more of the width of the sustaining electrode in the direction opposing the tow sustaining electrodes each other in the pair of the sustaining electrodes, the effect of the present invention can be realized. And at least one of connecting electrodes for connecting the discharge gap region electrode and the main surface discharge electrode is disposed at the aperture that is disposed between the discharge gap region electrode and the main surface discharge electrode, and when the area of the connecting electrodes is 20% or less of the area of the aperture, the effect of the present invention can be realized. And when the thickness of the dielectric layer being nearly flat on the discharge gap region electrode is thinner than the thickness of the dielectric layer being nearly flat on the main surface discharge electrode, the effect of the present invention can be realized.

Further, the sustaining electrode disposed on the nearly flat surface of the first glass substrate further provides a metal bus line positioned at the opposite side of the discharge gap region electrode, and a second aperture disposed between the main surface discharge electrode and the metal bus line. And the metal bus line makes wiring resistance of the sustaining electrode low.

And the width of the second aperture disposed between the main surface discharge electrode and the metal bus line is wider than the width of the aperture disposed between the discharge gap region electrode and the main surface discharge electrode. Therefore, when a discharge is generated between the pair of the sustaining electrodes by applying voltages alternately to the pair of sustaining electrodes, and during a displaying discharge period in which the light emitting intensity of a light emitting display is changed, the discharge is not generated at the metal bus line beyond the second aperture.

And the component of the gas generating ultraviolet light to irradiate to the fluorescent material is Xe, Kr, Ar, or nitrogen, and the partial pressure of the gas is 100 hPa or more.

According to the structure of the PDP of the present invention, the electric current density at the surface discharge can be reduced, with sustaining the electric field strength largely in the discharge space near the discharge gap region electrodes facing each other, which affects largely the way of discharge between the pair of sustaining electrodes formed on an almost flat surface. Further, the intense discharge generated at the discharge gap is not sustained on the sustaining electrodes as it is, and can be transferred to the surface discharge by that the intense discharge is made to be low. Therefore, the high luminance efficacy can be realized with that the voltage sustaining the discharge is made to be low. With this, a PDP with high image quality and low power consumption having such as high luminance, high luminance efficacy, and high contrast can be realized.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A plasma display panel (PDP), comprising:

a group of plural pairs of sustaining electrodes covered with a dielectric layer on a first glass substrate by placing a discharge gap between said pair of sustaining electrodes; and a gas being filled up between said first glass substrate and a second glass substrate facing said first glass substrate, wherein:

an image is displayed on said PDP by irradiating ultraviolet light, which is obtained by making said group of plural pairs of said sustaining electrodes on said first glass substrate discharge by applying voltages to said group of plural pairs of said sustaining electrodes, on a fluorescent material, wherein:

a sustaining electrode in said pair of sustaining electrodes disposed on the nearly flat surface of said first glass substrate, comprising:

a discharge gap region electrode;

a main surface discharge electrode; and an aperture disposed between said discharge gap region electrode and said main surface discharge electrode, wherein:

said main surface discharge electrode is composed of plural fine patterned wires and/or opening parts where electrodes are not formed.

2. A PDP in accordance with claim 1, wherein:

the area of said main surface discharge electrode is 50% or less of the area of the region where said main surface discharge electrode is formed.

3. A PDP in accordance with claim 1, wherein:

the area of said main surface discharge electrode is 30% or less of the area of the region where said main surface discharge electrode is formed.

4. A PDP in accordance with claim 1, wherein:

the width of said fine patterned wire, of which said main surface discharge electrode is composed, is twice as narrow as or less of the value of the thickness of said dielectric layer for insulating said main surface discharge electrode from a discharge space.

5. A PDP in accordance with claim 1, wherein:

the width of said discharge gap region electrode is 20% or less of the width of said sustaining electrode, disposed on said nearly flat surface of said first glass substrate, in the direction opposing the two sustaining electrodes each other in said pair of said sustaining electrodes.

6. A PDP in accordance with claim 1, wherein:

the width of said discharge gap region electrode is 10% or less of the width of said sustaining electrode, disposed on said nearly flat surface of said first glass substrate, in the direction opposing the two sustaining electrodes each other in said pair of said sustaining electrodes.

7. A PDP in accordance with claim 1, wherein:

the width of said aperture, which is disposed between said discharge gap region electrode and said main surface discharge electrode, is 10% or more of the width of said sustaining electrode in the direction opposing the two sustaining electrodes each other in said pair of said sustaining electrodes.

8. A PDP in accordance with claim 1, wherein:

the width of said aperture, which is disposed between said discharge gap region electrode and said main surface discharge electrode, is 20% or more of the width of said sustaining electrode in the direction opposing the two sustaining electrodes each other in said pair of said sustaining electrodes.

9. A PDP in accordance with claim 1, wherein:

the thickness of said dielectric layer being nearly flat on said discharge gap region electrode is thinner than the thickness of said dielectric layer being nearly flat on said main surface discharge electrode.

10. A PDP in accordance with claim 1, wherein:

the component of said gas generating ultraviolet light to irradiate to said fluorescent material is Xe, Kr, Ar, or nitrogen, and the partial pressure of said gas is 100 hPa or more.

11. A PDP in accordance with claim 1, wherein:

at least one of connecting electrodes for connecting said discharge gap region electrode and said main surface discharge electrode is disposed at said aperture that is disposed between said discharge gap region electrode and said main surface discharge electrode.

12. A PDP in accordance with claim 11, wherein:

the area of said connecting electrodes is 20% or less of the area of said aperture.

13. A PDP in accordance with claim 1, wherein:

said sustaining electrode disposed on the nearly flat surface of said first glass substrate, further comprising:

a metal bus line positioned at the opposite side of said discharge gap region electrode and connected with both said discharge gap region electrode and said main surface discharge electrode; and a second aperture disposed between said main surface discharge electrode and said metal bus line, wherein: said metal bus line makes wiring resistance of said sustaining electrode low.

14. A PDP in accordance with claim 13, wherein:

the width of said second aperture disposed between said main surface discharge electrode and said metal bus line is wider than the width of said aperture disposed between said discharge gap region electrode and said main surface discharge electrode.

15. A PDP in accordance with claim 14, wherein:

a discharge is generated between said pair of said sustaining electrodes by applying voltages alternately to said pair of sustaining electrodes, and during a displaying discharge period by which the light emitting intensity of a light emitting display is controlled, said discharge is not spread in the region of said metal bus line beyond said second aperture.

* * * * *